US005701936A

United States Patent [19]

Miller

[11] Patent Number: 5,701,936

[45] Date of Patent: Dec. 30, 1997

[54] TUCKING DEVICE FOR WIRE WEAVING MACHINES AND METHOD

[75] Inventor: James R. Miller, Greenville, S.C.

[73] Assignee: Precision Research & Development, Greenville, S.C.

[21] Appl. No.: 612,427

[22] Filed: Mar. 7, 1996

[51] Int. Cl.[6] ..... B21F 27/14

[52] U.S. Cl. ..... 140/24

[58] Field of Search ..... 140/24; 139/434, 139/302, 291 C

[56] References Cited

U.S. PATENT DOCUMENTS 3,424,207 1/1969 Krebs ..... 140/24

4,142,559 3/1979 Sbabo ..... 139/434

FOREIGN PATENT DOCUMENTS 1-97239 4/1989 Japan ..... 139/434

*Primary Examiner*—Lowell A. Larson

*Attorney, Agent, or Firm*—Ralph Bailey

[57] ABSTRACT

Tucking apparatus for weaving multiple narrow panels having a selvage on both sides of each panel upon a wire weaving machine has a cutter (B) operated by suitable linkage from a cutter cam (A) mounted upon a transverse synchronizing shaft and a forming finger cam (C) also mounted upon the synchronizing shaft which positively operates opposed forming fingers (D).

7 Claims, 3 Drawing Sheets

TUCKING DEVICE FOR WIRE WEAVING MACHINES AND METHOD

BACKGROUND OF THE INVENTION

This invention relates to an improved tucking device for a wire weaving machine useful for forming multiple narrow width panels.

The invention is described in the context of a Sulzer P 7100 weaving machine where, in a wire weaving configuration, stationary cutters are employed and forming fingers are positively moved in one direction but springs are relied upon for return after completion of a tucking operation. The action of the reed on the beat up motion of the weaving machine sometimes exerts an uneven pulling action of the filling wire against the stationary cutter causing irregular positioning of the filling wire and non-uniform tucking at the selvage. The filling wire is carried on a picking motion by a projectile type shuttle of the general type illustrated in U.S. Pat. No. 3,712,345 for use on weaving machines as referred to therein. It has heretofore been very difficult to weave multi-screen wire panels and even where such is accomplished quality often suffers. Since various widths of screen wire having selvages on both sides are desirable, it would be an important advantage if it were possible to readily weave multi-panels of desired width at the same time on the same weaving machine.

SUMMARY OF THE INVENTION

Accordingly, it is an important object of the present invention to provide a tucking device for use on weaving machines in a wire weaving configuration wherein it is possible to weave narrow panels all at the same time so as to provide opposed salvages on each narrow panel.

Another important object of the invention is the provision of an improved tucking unit which has a moveable positively operated cutter controlled in both the cutting and return directions through linkage operated from a synchronizing shaft, sometimes referred to as the telescoping shaft, which extends from the picking mechanism end of the weaving machine transversely to the receiving side for synchronizing the picking and receiving motions of the weaving machine.

Another important object of the invention is the provision of a positive mechanism for operating the tucking fingers which has a positive action in both the tucking and return directions avoiding dependence upon springs which have a tendency to exert varying forces as they are subjected to wear on the weaving machine.

The method is accomplished by mounting a cutter cam for movement responsive to rotation of the synchronizing shaft, pivotally mounting a vertical cutter member for movement responsive to movement of the cutter cam, mounting a forming finger cam for movement responsive to rotation of the synchronizing shaft, and pivotally mounting a pair of opposed horizontal forming fingers for simultaneous movement outwardly to tucking position responsive to movement of the forming finger cam.

Thus, a filling wire is cut and, on a subsequent cycle of the weaving machine, tucked in adjacent selvages of adjacent wire panels in timed positively controlled sequences responsive to movements of a cutter cam and a forming finger cam, respectively.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for tucking wire on adjacent selvages of adjacent panels on a wire weaving machine having a synchronizing shaft 22 (FIG. 1) operated on one end by picking mechanism and extending transversely to receiving mechanism on the other end. A cutter cam A (FIG. 2) is mounted for movement responsive to rotation of the synchronizing shaft. A vertical cutter member B (FIGS. 2 and 4) is mounted on a transverse shaft for movement responsive to movement of the cutter cam. A forming finger cam C (FIG. 3) is mounted for movement responsive to rotation of the synchronizing shaft. A pair of opposed horizontal forming fingers D (FIGS. 3 and 4) are mounted on opposed vertical shafts for movement responsive to movement of the forming finger cam. Thus, a filling wire is cut and tucked in opposed selvages of adjacent wire panels in timed positively controlled sequences responsive to movements of the cutter cam and the forming finger cam respectively.

Figure 1:
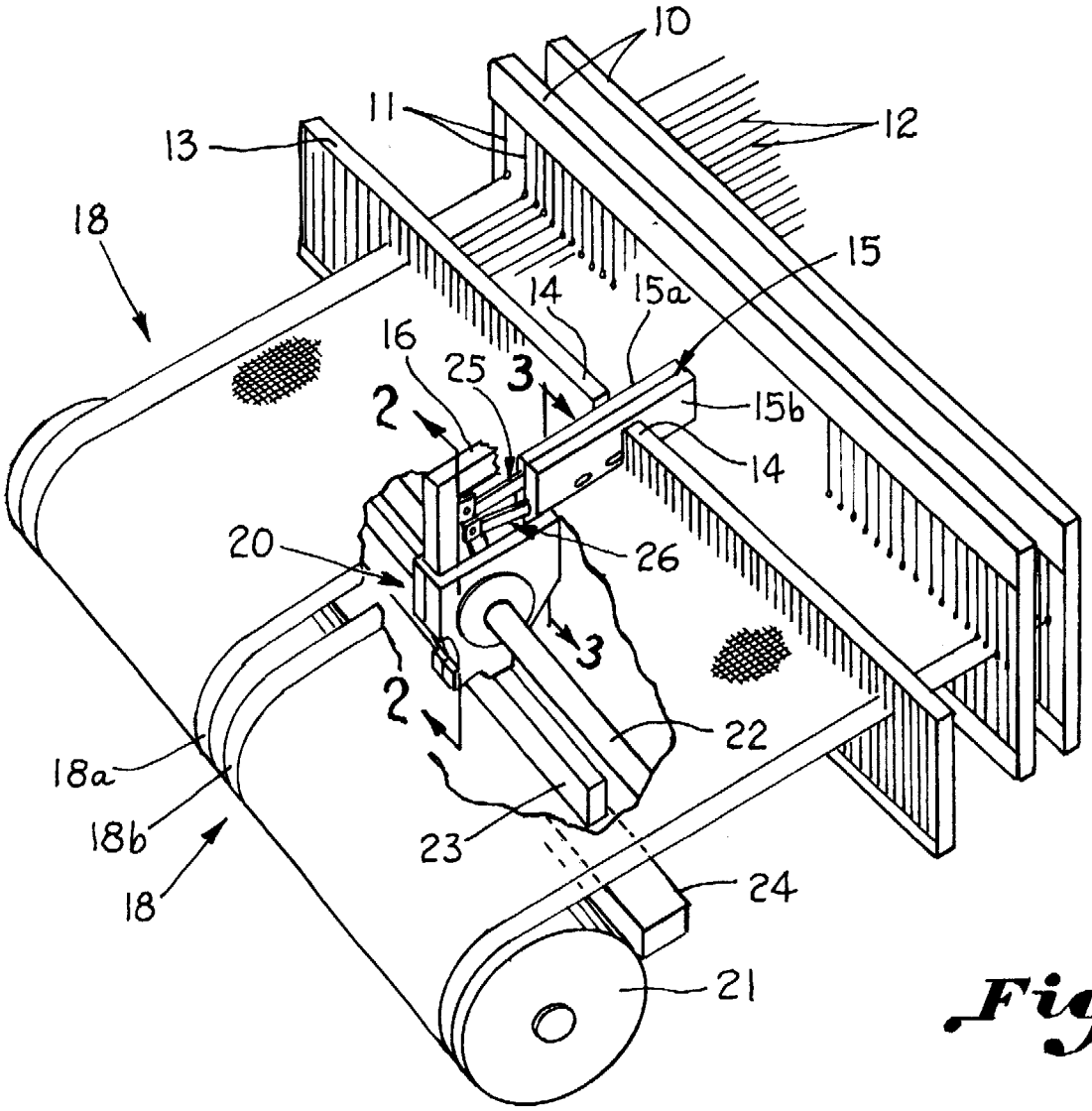
FIG. 1 is a perspective view, with parts broken away, illustrating a tucking device, constructed in accordance with the invention, in operating position on a weaving machine configured for weaving two wire panels.

Referring more particularly to FIG. 1, harnesses 10 are illustrated as having heddles 11 for separating warp wires 12. A reed is illustrated at 13 which is split in the center as at 14 to accommodate a split housing broadly designated at 15 having opposed halves **15*a* and 15*b*. The housing is suspended upon a top bar 16 which extends forwardly through the heddles of the harnesses 10 for separating the warp for manufacturing two wire panels broadly designated at 18. The top bar 16 which carries the split upper housing 15 is suitably supported as by the bar 16*a* and bolts 19*a* and 19*b* (FIG. 3) on a split lower housing broadly designated at 20. The bolts 19*a* raise the top bar against an upper limit adjustably determined by the bolt 19*b* connected to the upper housing. The panels 18 are illustrated in FIG. 1 as having opposed selvages 18*a* and 18*b* as formed by the center tucking unit and such are illustrated as being wound upon the takeup roll 21. The split lower housing 20 is illustrated as being carried upon the synchronizing shaft 22 which extends between the picking mechanism (not shown) on the left hand side of FIG. 1 to the receiving mechanism (not shown) on the right hand side of FIG. 1. The filling wire is carried by a shuttle (not shown) of the projectile type on a picking motion from left to right in FIG. 1. A base of the lower housing 20 is supported upon a bar 23 which in turn is carried by the main girt 24** of the weaving machine.

Suitable linkage for operating the cutter is broadly designated at 25 in FIG. 1 while linkage is broadly designated at 26 in FIG. 1 for operating the forming fingers.

The split housing 15 is carried upon the split housing 20 as described above. This permits adjustment of the split housing 15, containing the filling cutter B and the forming fingers D described below, forward and backward toward and away from the harnesses 10 to facilitate adjustment for optimum results.

Figure 2:
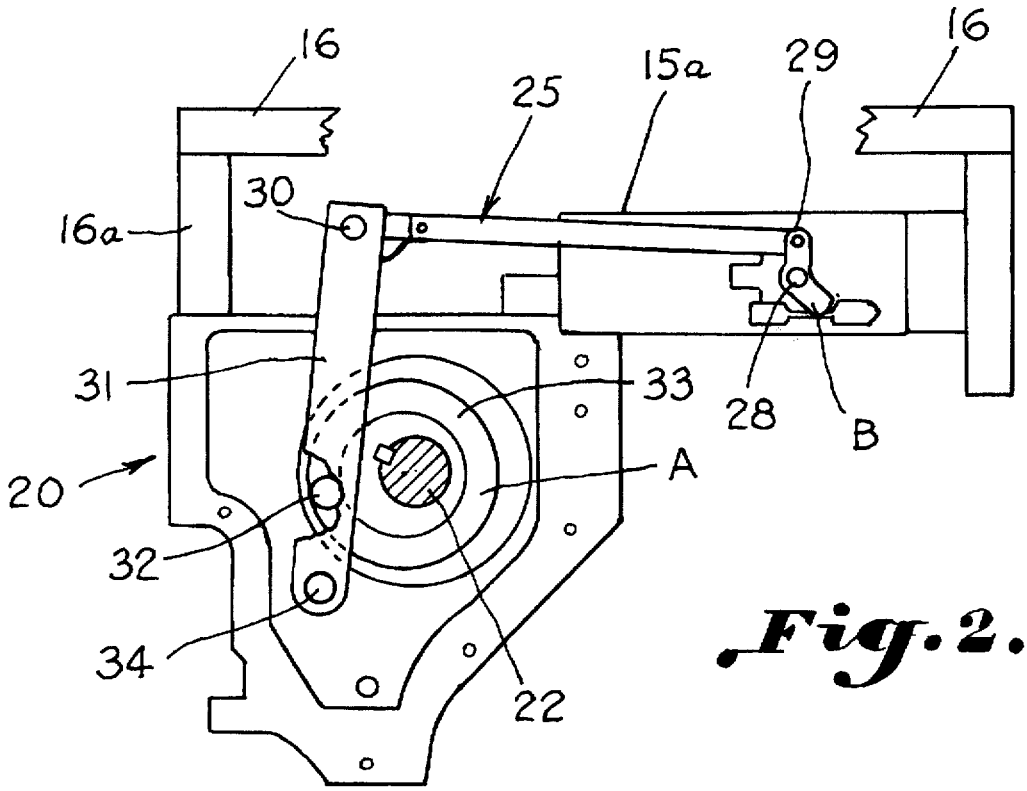
FIG. 2 is an enlarged longitudinal elevation taken on the line 2—2 in FIG. 1 illustrating linkage for operating the cutter with the cutter in closed position.

Referring more particularly now to FIG. 2, it will be noted that the cutter B is illustrated in closed position for exerting a cutting action upon the filling wire. The cutter is pivotally mounted as at 28 within the split upper housing 15*a* opposite the housing portion 15*b* and is pivotally connected as at 29 to the linkage mechanism 25. The linkage mechanism 25 is pivotally connected as at 30 to a vertical lever 31 which carries a cam follower 32 which rides within a closed arcuate cam track 33 upon the cam A. It will be noted that the lever 31 is pivotally mounted as at 34 in the split lower housing section illustrated at 20*a*.

Figure 3:
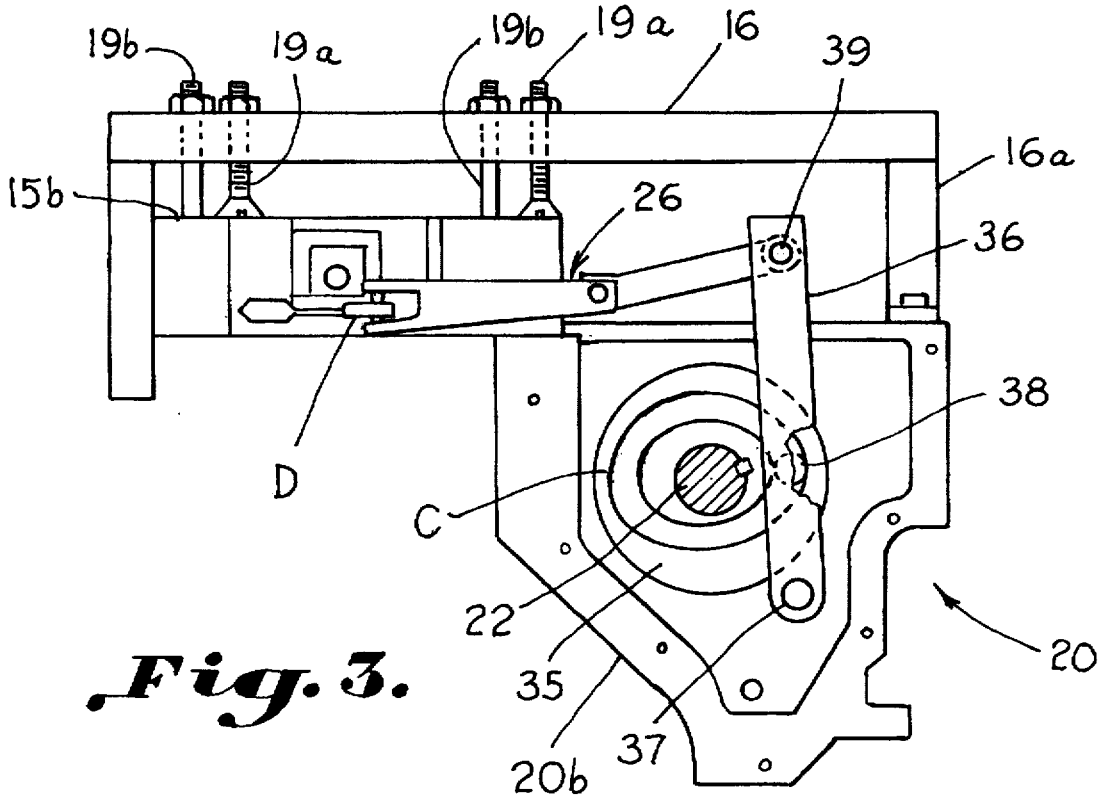
FIG. 3 is a longitudinal elevation taken on the line 3—3 in FIG. 1 illustrating the linkage for operating the forming fingers.

Referring to FIG. 3, a forming finger cam is illustrated at C which is mounted upon the synchronizing shaft 22 on an opposed half of the lower split housing 20*b*. An upright lever is illustrated at 36 which is pivoted on the lower end as at 37 upon the lower split housing 20*b*. A cam follower is illustrated at 38 for motion within a closed arcuate cam track 35 carried upon the forming fingers cam C. The lever 36 is pivotally connected as at 39 to the linkage 26 for operating the forming fingers D.

Figure 4:
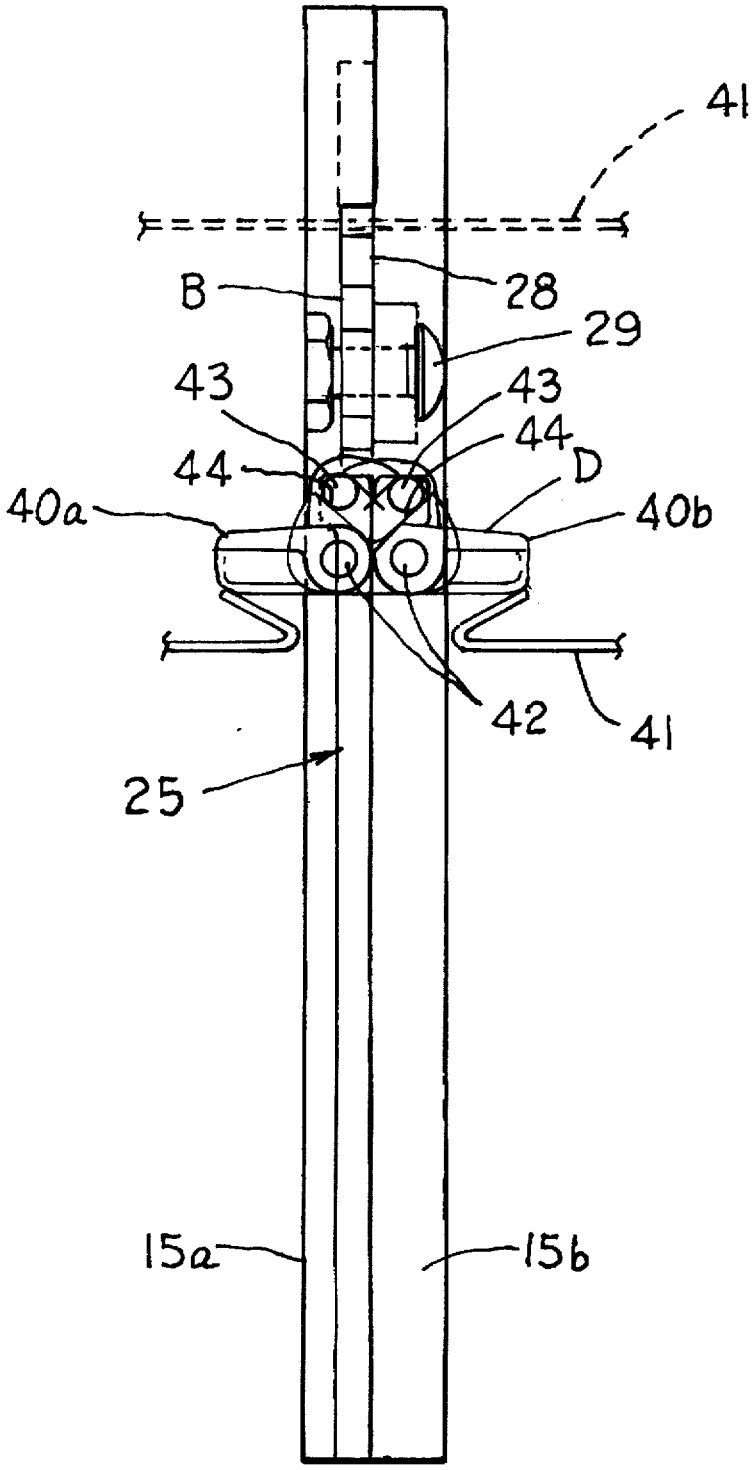
FIG. 4 is a schematic plan view illustrating a split housing mounting and carrying the cutter and the forming fingers with operating linkage therefor with the parts in position with the wire illustrated in broken lines as having been cut and with the forming fingers beginning to bend the wire on a subsequent cycle of the weaving machine.

Referring now to FIG. 4, it will be observed that the filling wire is illustrated in a first position in broken lines as at 41 as having been cut by a lower cutting surface of the cutter B on a beat up motion of the weaving machine. The forming fingers 40*a* are illustrated on opposed operable position with one of the fingers extending outwardly on one side with the other forming finger 40*b* extending outwardly on the other side when moved to tucking position by the linkage 26. As further illustrated in FIG. 4, the bending of the filling wire 41 is illustrated in a second position as at 41*a* and 41*b*. The forming fingers are pivoted upon respective pins 42. Pins 43 carried by respective slots 44 in the forming fingers move the fingers outwardly to the position shown in FIG. 4 responsive to movement of the linkage 26, and are maintained on the same horizontal plane. The fingers are positively returned by the linkage 26 upon completion of a tucking operation. The tucking operation follows cutting and is accomplished by the action of the forming fingers upon a subsequent cycle of the weaving machine.

Thus, FIGS. 2 and 4 show the cutter B in closed position for cutting a wire 41. The cutter is pivotally connected at 29 to linkage 25 which is driven from the cutter cam A on the synchronizing shaft 22 for opening and closing the cutter. FIGS. 3 and 4 show that the forming fingers D are operated by pins 43 through linkage 26 from the forming fingers cam C also on the synchronizing shaft 22.

While the invention has been described in connection with a particular type of wire weaving machine, it is to be understood that apparatus constructed in accordance with the invention may be applied to other wire weaving apparatus. The tucking apparatus has been illustrated as being positioned centrally, although additional center tucking units may be employed spaced as desired on the loom to manufacture multiple panels of varying widths.

While a preferred embodiment of the invention has been described using specific terms, such description is for illustrative purposes only, and it is to be understood that changes and variations may be made without departing from the spirit or scope of the following claims.

What is claimed is:

1. Apparatus for tucking wire on opposed selvages on a wire weaving machine having a synchronizing shaft operated on one end by picking mechanism and extending transversely to receiving mechanism on the other end comprising:

a cutter cam mounted for movement responsive to rotation of said synchronizing shaft;

a cutter member pivotally mounted for movement responsive to movement of said cutter cam;

a forming finger cam mounted for movement responsive to rotation of said synchronizing shaft; and a pair of opposed horizontal forming fingers mounted on opposed vertical shafts for movement responsive to movement of said forming finger cam;

whereby a filling wire is cut and tucked in opposed selvages of adjacent wire panels in timed positively controlled sequences responsive to movements of said cutter cam and said forming finger cam respectively.

2. The structure set forth in claim 1 including a pair of upright levers pivotally mounted adjacent lower ends thereof adjacent said synchronizing shaft and cam followers carried in an intermediate portion of respective levers operating linkage connected adjacent the other ends of respective levers for moving said cutter and said forming fingers respectively.

3. The structure set forth in claim 2 wherein said cams have opposed continuous arcuate tracks carrying respective cam followers.

4. The structure set forth in claim 1 wherein said cutter is pivotally mounted in a vertical plane for movement to cut said filling wire on a beat up motion of the weaving machine.

5. The structure set forth in claim 4 wherein said forming fingers are pivotally mounted so as to move outwardly in opposed relation to engage and to bend ends of cut wire, said forming fingers being in the same plane and remaining in said opposed relation for completing the tucking action upon a subsequent cycle of the weaving machine.

6. The method of weaving multiple wire panels by tucking wire on opposed selvages on a wire weaving machine having a synchronizing shaft operated on one end by picking mechanism and extending transversely to receiving mechanism on the other end comprising the steps of:

mounting a cutter cam for movement responsive to rotation of said synchronizing shaft;

pivotally mounting a vertical cutter member on a transverse shaft for movement responsive to movement of said cutter cam;

mounting a forming finger cam for movement responsive to rotation of said synchronizing shaft; and pivotally mounting a pair of opposed horizontal forming fingers on opposed vertical shafts for movement responsive to movement of said forming finger cam;

whereby a filling wire is cut and tucked in opposed selvages of adjacent wire panels in timed positively controlled sequences responsive to movements of said cutter cam and said forming finger cam respectively.

7. The method set forth in claim 6 including the steps of cutting said filling wire by pivotal movement of said cutter member on a beat up motion of the weaving machine; then pivotally moving said forming fingers outwardly to bend ends of cut wire causing said forming fingers to complete the tucking action upon a subsequent cycle of the weaving machine.

* * * * *